United States Patent [19]

Nagel et al.

[11] Patent Number: 4,855,750

[45] Date of Patent: Aug. 8, 1989

[54] DIPOLE EXCITER FOR AN ANTENNA

[75] Inventors: Reimer Nagel; Ralf Wendel, both of Hanover, Fed. Rep. of Germany

[73] Assignee: kabelmetal electro Gesellschaft mit beschränkter Haftung, Hanover, Fed. Rep. of Germany

[21] Appl. No.: 234,814

[22] Filed: Aug. 22, 1988

[30] Foreign Application Priority Data

Oct. 17, 1987 [DE] Fed. Rep. of Germany ..... 3735226

[51] Int. Cl.[4] ..... H01Q 13/10

[52] U.S. Cl. ..... 343/770; 343/771; 343/905; 343/768

[58] Field of Search ..... 343/771, 770, 768, 833, 343/832, 840, 905, 793

[56] References Cited

U.S. PATENT DOCUMENTS

| | | | |
|---|---|---|---|
| 2,611,867 | 9/1952 | Alford | 343/770 |
| 2,954,556 | 9/1960 | Yang | 343/770 |
| 3,524,190 | 8/1970 | Killion et al. | 343/771 |
| 3,975,733 | 8/1976 | Bogner | 343/833 |
| 4,129,871 | 12/1978 | Johns | 343/771 |
| 4,301,457 | 11/1981 | Bogner | 343/833 |

OTHER PUBLICATIONS

Silver, "Microwave Antenna Theory and Design", 1949, McGraw Hill, pp. 244–255.

*Primary Examiner*—Rolf Hille
*Assistant Examiner*—Hoanganh Le
*Attorney, Agent, or Firm*—Martin A. Farber

[57] ABSTRACT

A dipole exciter for an antenna for the transmission of electromagnetic waves which is arranged on the free end of a rigid co-axial line is described. The dipole consists of two flat metal pieces (10, 11) which are arranged on the outer conductor (6) of the line and the main dimension of which extends at right angles to the axis of said line.

6 Claims, 2 Drawing Sheets

DIPOLE EXCITER FOR AN ANTENNA

FIELD AND BACKGROUND OF THE INVENTION

The invention relates to a dipole exciter for an antenna with parabolic reflector for transmitting electromagnetic waves, consisting of a rigid co-axial line fastened at one end to the reflector and having an inner conductor, an outer conductor concentrically surrounding said inner conductor with dielectric contained between the two conductors, in which connection a dipole connected in electrically conductive manner with the outer conductor is arranged on the free end of the conductor lying approximately at the focal point of the reflector, two axially extending slots which lie diametrically opposite each other being arranged in the outer conductor within the region of the dipole, and inner and outer conductors being short-circuited at a narrowly limited place in circumferential direction in the region of the slots (U.S. book by S. Silver, "Microwave Antenna Theory and Design", 1949, McGraw-Hill).

Such an exciter is used, for instance, for the illuminating of directional antennas with parabolic reflectors for radio direction finding, satellite communications or radio location. For the direct illuminating of the reflector it is arranged approximately at the focal point thereof. "Illuminating" in this connection comprises both directions of transmission of the electromagnetic waves and therefore the waves to be sent out and those to be received.

In the known dipole exciter according to the aforementioned U.S. book, the dipole consists of two bars which protrude in radial direction from the outer conductor of the co-axial line. By the short-circuit between inner conductor and outer conductor, the line is made symmetric at the end. By this measure in cooperation also with the slots in the outer conductor the dipole can be placed in oscillation. This known dipole exciter is limited to a relatively narrow frequency band with respect to the electromagnetic waves to be transmitted. It is used, for instance, for the region of 1.7 to 1.9 GHz, and therefore a bandwidth of 200 MHz. Upon a widening of the frequency range, such high reflections result from the superimposing of return waves that the signals to be transmitted are falsified. For different frequency ranges therefore, a relatively large number of different dipoles exciters must be manufactured and possibly kept in stock.

SUMMARY OF THE INVENTION

It is an object of the invention to provide a dipole exciter which operates free of disturbance within a substantially broader frequency band.

Accordingly, in a dipole exciter of the type described above, the invention provides:

the dipole consists of two flat metal pieces (10, 11) which lie diametrically opposite each other on the outer conductor (6) and extend parallel to each other, their wall thickness being small as compared with their other dimensions; and the two metal pieces (10, 11) are so arranged on the outer conductor (6) that their main dimension extends tangentially to the co-axial line (4).

By the use of the two flat metal pieces the flat sides of which rest against the outer conductor of the co-axial line, there is obtained a dipole exciter which can be used for substantially larger bandwidths than the dipole exciters known heretofore. By the two metal pieces which extend substantially tangentially to the co-axial line or perpendicular to the axis thereof, the reflection values of the dipole exciter remain so low over a wide frequency range, that the dipole exciter can be operated in this frequency range without falsification of the signals. The dipole exciter operates free of disturbance, for instance, for a frequency range of 1.7 GHz to 2.1 GHz. This corresponds to a bandwidth of 400 MHz. The number of dipole exciters intended for different frequency ranges can with this construction be reduced therefore by at least one-half. This results in substantial advantages not only in the manufacture of the dipole exciters but also in the stocking thereof.

According to a feature, the metal pieces (10, 11) are developed as disks.

Still further, the metal pieces (10, 11) are developed as strips.

Also according to the invention, a metallic cup (15) which extends over the metal pieces (10, 11) is arranged on the free end of the co-axial line (4), said part having a circumferential opening on the side thereof facing the reflector (1).

Yet another feature of the invention is that the opening of the cup (15) is closed by an annular disk (16) of dielectric material.

Furthermore, a metallic shielding plate (14) can be arranged on the free end of the co-axial line (4).

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

The parabolic reflector 1 of an antenna is placed by means of a mount shown merely schematically on a support 2, and is fastened to said support. A dipole exciter 3 is arranged approximately at the focal point of the reflector 1. The dipole exciter is located at one end of a rigid co-axial line 4 the other end of which is fastened to the reflector 1. The more detailed construction of the dipole exciter 3 can be noted from FIGS. 2 to 8.

Figure 6:
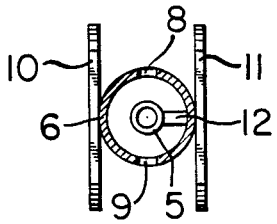
FIG. 6 is a cross-section through the dipole exciter.
Figure 7:
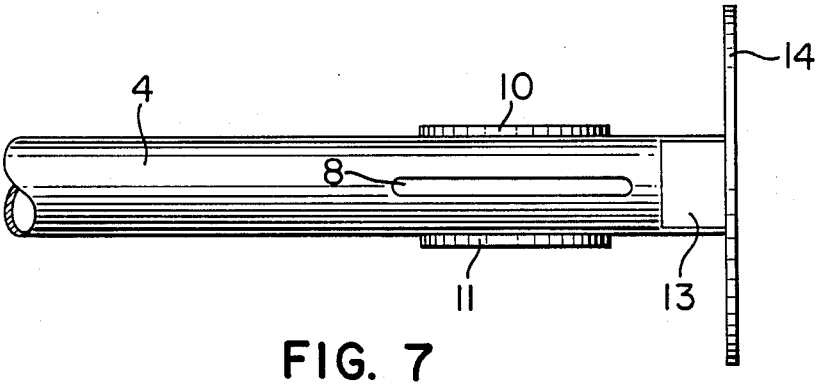
FIG. 7 shows the dipole exciter in completed form.
Figure 8:
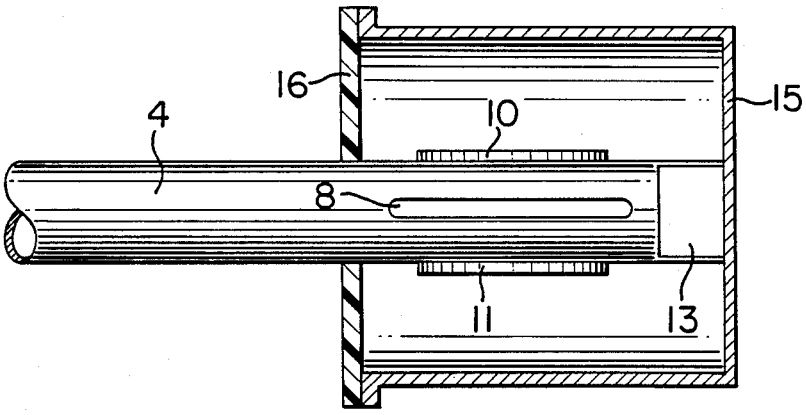
FIG. 8 is an embodiment which was modified as compared with FIG. 7.

The line 4 consists, as shown in FIG. 6, of an inner conductor 5 and an outer conductor 6 which surrounds the inner conductor, spaced from it. Between the two conductors a spacer of insulating material can be arranged. Both conductors can consist, for instance, of copper, brass or aluminum. The line 4 serves for the conducting of electromagnetic waves which are radiated or received by the antenna. It is connected on the reflector 1 to a further extending line 7.

In the vicinity of its remote end, the outer conductor 6 has slots 8 and 9 (FIG. 6) which extend paraxially to the outer conductor 6 and lie diametrically opposite each other therein. On the outside of the outer conductor 6 there are furthermore two flat metal pieces 10 and 11 which extend parallel to each other, and the main dimension of which is tangential to the co-axial line 4 or perpendicular to its axis. The wall thickness of the metal pieces 10 and 11 is small as compared with the dimensions of the main dimension. They lie diametrically opposite each other on the outer conductor 6 and together represent the dipole of the dipole exciter. The connecting center lines between the slots 8 and 9, on the one hand, and the metal pieces 10 and 11, on the other hand, extend at right angles to each other in wellknown technique.

Figure 1:
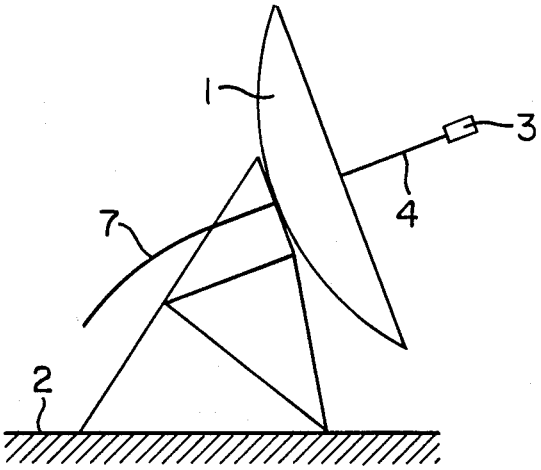
FIG. 1 schematically shows the reflector of an antenna having a dipole exciter according to the invention.
Figure 2:
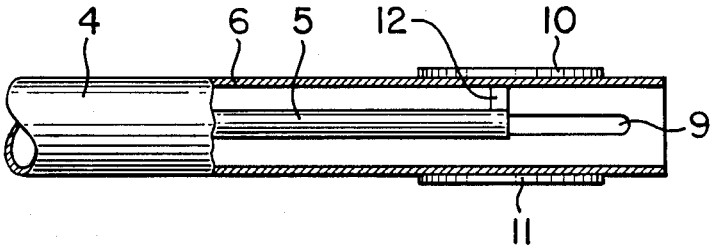
FIG. 2 is a longitudinal section through the dipole exciter in an enlarged view.
Figure 3:
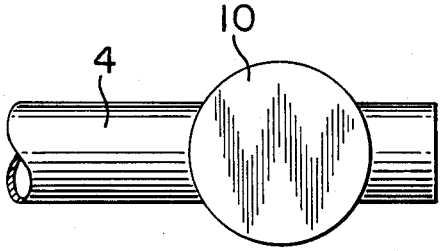
FIGS. 3 and 4 are side views of three different embodiments of the dipole exciter.
Figure 5:
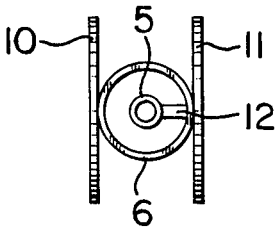
FIG. 5 is an end-view of the dipole exciter.
Figure 4:
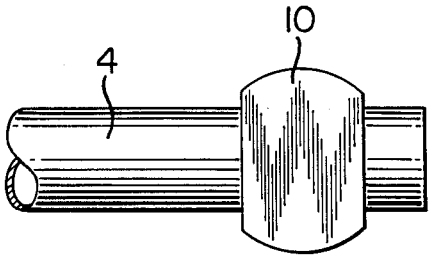

The metal pieces 10 and 11 can be developed, for instance, as circular disks, as shown in FIG. 3. However, they can also be developed as strips, the main dimension of which extends at a right angle to the axis of the line 4, as shown in FIG. 4. In principle, the geometrical shape of the metal pieces 10 and 11 may be any desired. They must only have a small wall thickness as compared with their main dimension, this main dimension extending in any way substantially tangentially to the outer conductor 6. They can be dimensioned in accordance with following two examples as a function of the frequency range:

EXAMPLE 1

Frequency range 1.7 to 2.1 GHz. The metal pieces 10 and 11 have, as circular disks, a diameter of about 50 mm. The wall thickness is about 1.5 mm.

EXAMPLE 2

Frequency range 1.9 to 2.3 GHz. The metal pieces 10 and 11 have, as circular disks, a diameter of about 50 mm. The wall thickness is about 0.5 mm.

The line 4 is made symmetric in the region of the slots 8 and 9, and thus in the region of the dipole. In addition, inner conductor 5 and outer conductor 6 are short-circuited in this region by an electrically conductive bridge 12. For further improvement of the reflection factor, the end of the inner conductor 5 is furthermore matched by known technique, for instance, by a transformation member.

In order to avoid the propagation in the wrong direction of the waves radiated by the dipole exciter, a metallic shielding plate 14 can be arranged on the end of the line 4 with the interpositioning of a metallic intermediate piece 13. The shielding plate 14 shields the dipole exciter off also from reception of waves from the wrong direction.

For the further improving of the shielding, a metallic cup 15 can be placed over the dipole exciter, again with the inter-positioning of the metallic intermediate piece 13, the cup having a circumferential opening in the direction of the reflector. In order to prevent dirt from entering the cup 15 and in order possibly to maintain pressure in the cup 15, the cup can be closed with an annular disk 16 of dielectric material.

We claim:

1. A dipole exciter for an antenna with parabolic reflector for transmitting electromagnetic waves, comprising:

a rigid coaxial line fastened at one end to the reflector and having an inner conductor, an outer conductor concentrically surrounding said inner conductor, and a dielectric contained between the two conductors;

a dipole connected in electrically conductive manner with the outer conductor, said dipole being disposed on a free end of the outer conductor and being situate approximately at the focal point of the reflector; and wherein two axially extending slots are formed on the outer conductor, the slots lying diametrically opposite each other and being arranged within the region of the dipole, the inner and the outer conductors being short-circuited at a narrowly limited place in circumferential direction in the region of the slots, the improvement wherein the dipole comprises two flat metal pieces which lie in spaced-apart planes diametrically opposite each other on the outer conductor and extend parallel to each other, the wall thickness of each metal piece being small as compared with its other dimensions; and wherein the two metal pieces are arranged on the outer conductor each with its main dimension extending tangentially to the outer conductor and parallel to an axis of the coaxial line.

2. A dipole exciter according to claim 1, wherein the metal pieces are formed as disks.

3. A dipole exciter according to claim 1, wherein the metal pieces are formed as strips.

4. A dipole exciter according to claim 1, further comprising a metallic cup which extends over the metal pieces, the cup being disposed on the free end of the coaxial line, the cup having a circumferential opening on the side thereof facing the reflector.

5. A dipole exciter according to claim 4, further comprising an annular disk of dielectric material, the opening of the cup being closed by the annular disk.

6. A dipole exciter according to claim 1, further comprising a metallic shielding plate located on the free end of the coaxial line.

* * * * *